United States Patent [19]

Wisnia et al.

[11] Patent Number: 4,538,769

[45] Date of Patent: Sep. 3, 1985

[54] GRINDING MILL CONSTRUCTION

[75] Inventors: Jack Wisnia, Montreal; Norman A. Stock, Beaconsfield, both of Canada

[73] Assignee: Dominion Engineering Works Limited, Lachine, Canada

[21] Appl. No.: 502,006

[22] Filed: Jun. 7, 1983

Related U.S. Application Data

[63] Continuation-in-part of Ser. No. 288,459, Jul. 30, 1981, abandoned.

[30] Foreign Application Priority Data

Nov. 28, 1980 [CA] Canada ..... 365775

[51] Int. Cl.[3] ..... B02C 17/18

[52] U.S. Cl. ..... 241/179; 241/299

[58] Field of Search ..... 241/176, 177, 178, 179, 241/284, 299

[56] References Cited

U.S. PATENT DOCUMENTS

| | | | |
|---|---|---|---|
| 1,414,768 | 5/1922 | Behneman | 241/176 X |
| 3,027,104 | 3/1962 | Hall | 241/176 |
| 3,742,779 | 7/1973 | Shaver | 241/176 X |

*Primary Examiner*—Mark Rosenbaum

*Attorney, Agent, or Firm*—Raymond A. Eckersley

[57] ABSTRACT

There is disclosed a mill head structure for a large grinding mill. The mill head structure includes a conical head portion having a central axis and including a rib portion and a gear flange portion integrally cast therewith. The rib portion extends radially outward from the conical head portion and is arranged for assembling the head structure to the grinding mill so as to stiffen the gear flange portion against deformation under load. The gear flange portion has a periphery centered about the central axis of the conical head portion. The mill head structure further includes a plurality of gear rim segments which are positioned in juxtaposed relation around the periphery of the gear flange portion. The gear rim segments are removably secured with the gear flange portion to provide a continuously toothed gear annulus for accurate meshing relation with one or more pinions. Due to the large size of the grinding mill, the conical head portion comprises a plurality of segmental portions which are arranged in mutually complementary relation. The novel mill head structure provides for the easy replacement of damaged rim segments.

9 Claims, 5 Drawing Figures

GRINDING MILL CONSTRUCTION

This application is a continuation-in-part of application Ser. No. 288,459 filed July 30, 1981, now abandoned.

The present invention relates to a mill head structure suitable for use in large grinding mills. In particular, it relates to a mill head struture which may made of one or more integrally cast elements each comprised of a conical head portion, a rib portion extending radially outward from the head portion and a gear flange portion at the radial outer extremity of the rim portion and having replaceable rim segments.

A grinding mill commonly includes a hollow drum rotatably arranged about two trunnions by two conical head portions positioned at opposing ends of the drum. Each conical head portion comprises a plurality of segments bolted together to form a composite structure. The conical head portion is provided with an inner annular flange and an outer annular flange for securing the conical head portion respectively to a trunnion and the drum.

Furthermore, the grinding mill is provided with a gear wheel which forms part of the gear mechanism that drives the grinding mill. The gear wheel commonly includes a plurality of segmental rim portions which are bolted together to form an annular rim. Cut into the rim are teeth which cooperate with one or more pinions. The annular rim is displaced radially outward of the drum by a rib. The rib is usually provided with a plurality of apertures through which bolts may pass to fasten the rib to the outer annular flange of the conical head portion and the flange of the drum. Such an arrangement is quite common in the art and is discussed in more detail in U.S. Pat. No. 3,742,779 which issued on July 3, 1973 and is assigned to the assignee of the instant application.

The gear wheel forms a part of a large speed reducing gear system which is provided to transmit the power from a prime mover to the high capacity grinding mill. The prime mover usually comprises an electrical prime mover having enhanced starting torque characteristics. In order to compensate for enhanced starting torque, the gear wheel has a very large diameter (about thirty feet and upward).

It should be understood that the accuracy with which the gear wheel must be constructed may be in the order of one ten-thousandths of an inch. Therefore, it is imperative that the gear wheel remains relatively rigid and is not subject to deformation under heavy loads. Considering, however, the large diameter of the gear wheel and the heavy loads applied to the gear wheel by the large grinding mill, the prior art gear wheel arrangement has been subject to some deformation. Thus, due to the relative flexibility of the prior art gear wheel when operating under heavy loads, there is ever present the danger of tooth breakage. As can be appreciated, when a tooth or teeth in the gear wheel break, the gear wheel must be replaced. In the above-noted patent, the gear wheel is arranged in a segmental manner whereby only the segment of the gear for which a tooth has broken need be replaced. The cost of the occurrence of tooth breakage and the replacement of gears is very burdensome. The manufacturing lead time for such large gears is up to two years, and difficulties in transportation of gears to the site create severe problems in replacing such gear-driven installations. The high capitalization costs of plants using large gears such as autogenous mills may be immobilized by extended non-productive down time due to gear breakage, making the economic disadvantage of the prior art gear wheel considerably significant. Another disadvantage with the prior art gear wheel is encountered during the installation of the mill. During the installation, it is desirable that the gear wheel is arranged such that the annular rim is concentric about a central axis for the head structure. This is necessary to reduce the risk of tooth breakage resulting from error in pitch or an indexing error.

It is therefore a feature of the present invention to provide in a grinding mill a mill head structure having a gear rim means that is easy to assemble and readily replaceable.

Briefly, the present invention provides mill head structure for a grinding mill that comprises a conical head portion and a plurality of gear rim means. The conical head portion has integrally cast therewith a rib portion extending radially outward from the conical head portion and a gear flange portion at the radial extremity of the rib portion. The gear flange portion has its periphery centered about a central axis for the conical head portion. The gear rim means are positioned in juxtaposed relation around the periphery of the gear flange portion in removably secured relation therewith to provide a continuously toothed gear annulus. Replacement or installation of one or more of the gear rim means is a simple operation because the gear rim means do not have to be centered with respect to the central axis. Furthermore, because only the gear rim means of the present invention are replaceable, the cost of replacement parts is less than that of a gear wheel. Also, stronger materials may be used for each of the gear rim means to provide a more durable gear because each of the gear rim means is relatively small and simple to manufacture by casting or forging techniques.

Additionally, the rib portion may be coextensive with the conical head portion resulting in a stiffer mill head structure. Further, the rib portion may be arranged for assembling the head structure to a drum of the grinding mill so as to stiffen the gear flange portion against deformation under load.

In one embodiment of the invention it is envisaged that the gear flange portion may comprise a polygonal shaped ring which has its periphery centered about the central axis of the conical head portion. Preferably, the gear flange portion comprises an annular ring centered about the central axis of the conical head portion.

The mill head structure may be made as a unitary structure, however, in larger grinding mills it may comprise a plurality of segmental portions, each comprised of an integrally cast element comprising a conical head portion, a rib portion and a gear flange portion; arranged in mutually complementary relation.

In accordance with the broad aspect of the present invention there is provided a mill head structure for a grinding mill having a hollow drum, the mill head structure comprising: a conical head portion having a central axis and including a rib portion and a gear flange portion integrally cast on a unit with said head portion, the rib portion extending radially outward from the conical head portion to support the gear flange portion and being arranged for assembling the head structure to the drum structure so as to stiffen the gear flange portion against deformation under load, and said gear flange portion having a periphery centered about the central axis of the conical head portion; and, a plurality of gear rim means, positioned in juxtaposed relation around the periphery of the gear flange portion, being removably secured with the gear flange portion to provide a continuously toothed gear annulus for accurate meshing relation with one or more pinions.

For better understanding of the nature and objects of the present invention, reference may be had by way of an example to the accompanying diagrammatic drawings, in which.

Figure 1:
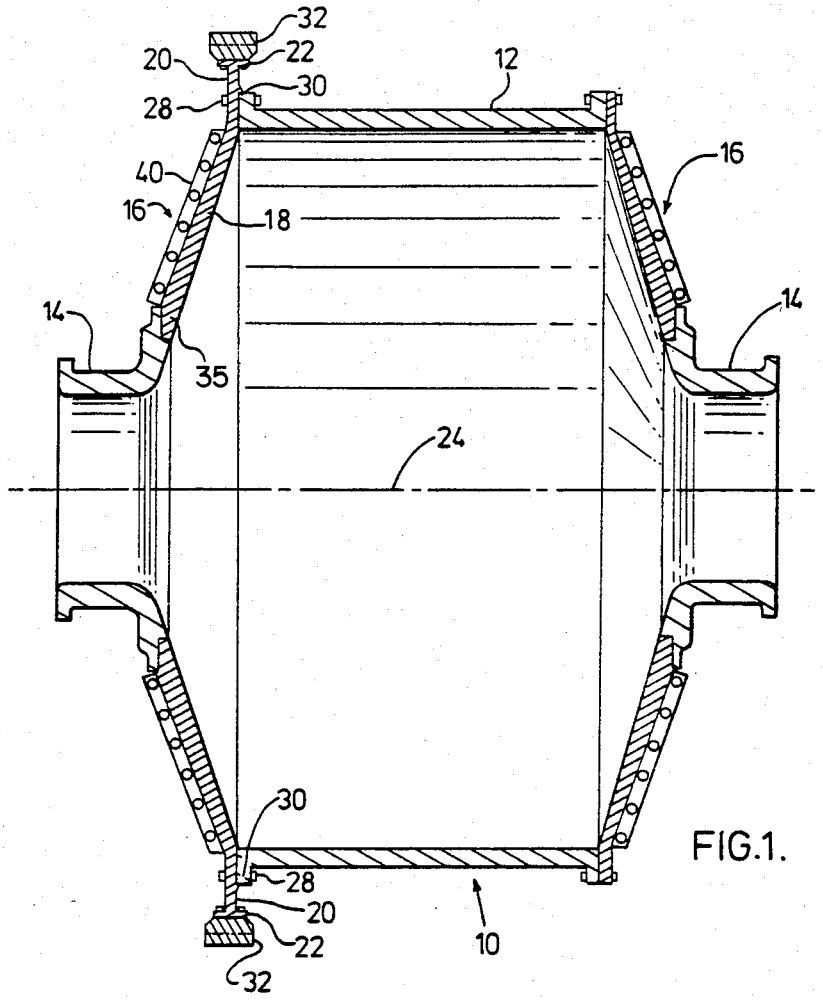
FIG. 1 is a sectional view of grinding mill of the present invention.

Referring to FIGS. 1 through 4 the preferred embodiment of the present invention is described. Grinding mill 10 is shown to include a drum 12 which is arranged in rotating relation about trunnions 14 by means of two mill head structures 16 located at opposing ends of drum 12.

Figure 2:
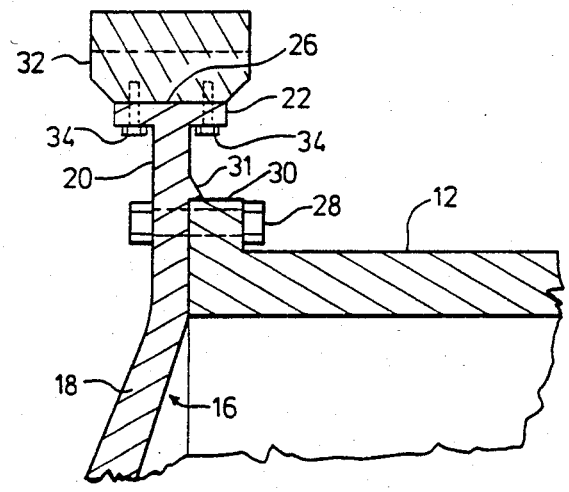
FIG. 2 is an enlarged sectional view showing the rim means, the gear flange portion, the rib portion, the conical head portion, and drum of the grinding mill.

Referring more particularly to FIG. 2, one of the mill head structures 16 is shown to comprise a conical head portion 18 which includes a rib portion 20 and a gear flange portion 22 cast as an integral unit. The conical head portion 18 is centered about its central axis 24 (see FIG. 1). As illustrated, the rib portion 20 radially extends outward from the conical head portion 18 to support the gear flange portion 22. The gear flange portion 22 comprises an annular ring which has its periphery 26 centered about the central axis 24. The rib portion 20 is arranged for assembling the one head structure 16 to the drum 12, as illustrated by bolts 28 passing through rib portion 20 and drum flange 30. By assembling the one mill head structure 16 to the drum 12 in this manner, the gear flange portion 22 is stiffened to the extent that it does not deform while the grinding mill 10 is operating under load. To further enhance the assembly of the one mill head structure 16 to drum 12, the rib portion 20 is provided with a lip portion 31 which overlays drum flange 30. The one mill head structure 16 further comprises a plurality of gear rim means, each designated 32. The rim means are positioned in juxtaposed relation about the periphery 26 of the gear flanged portion 22. The gear rim means 32 are removably secured with the gear flange portion, as illustrated by bolts 34 which pass through gear flange portion 22 into gear rim means 32.

Figure 3:
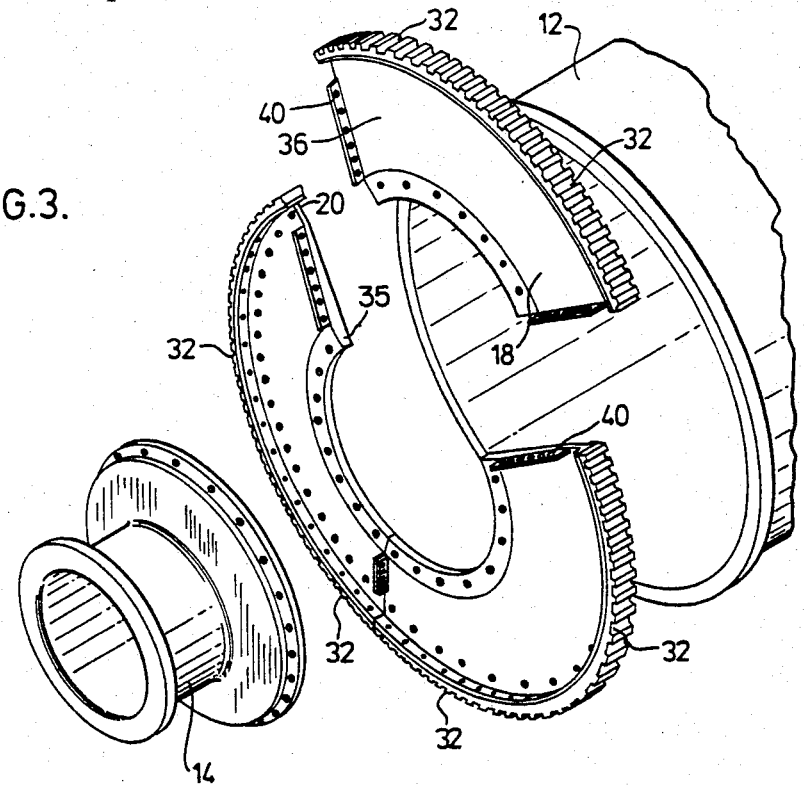
FIG. 3 is an exploded perspective view of the end structure of the grinding mill.

As illustrated in FIG. 3, the conical head portion 18 is provided with an inner annular flange 34 which is adapted for assembling the conical head portion 18 in secured relation with the trunnion 14 of the grinding mill 10.

Figure 4:
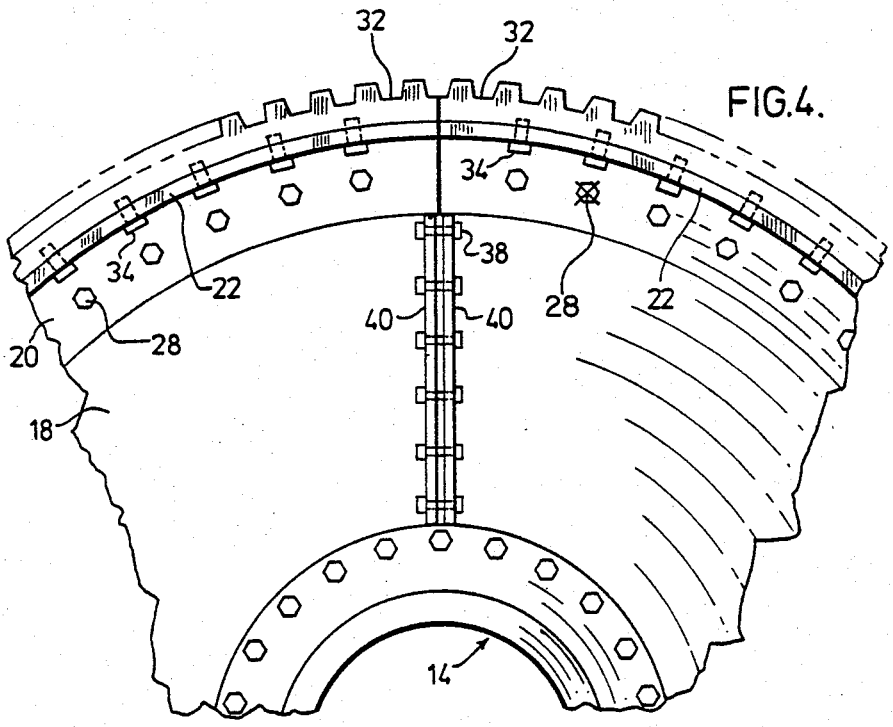
FIG. 4 is a partial end view of the head structure.

As illustrated in FIGS. 3 and 4, the conical head section 11 incorporating the head portion 18 may comprise a plurality of segmental portions 36 each cast as an integral structure including a head portion 18, rib portion 20 and gear flange portion 22. The segmental portions 36 are arranged in side by side relation, as illustrated by bolts 38 passing through adjacent flanges 40 of each segmental portion 36 to form the head structure 16.

Figure 5:
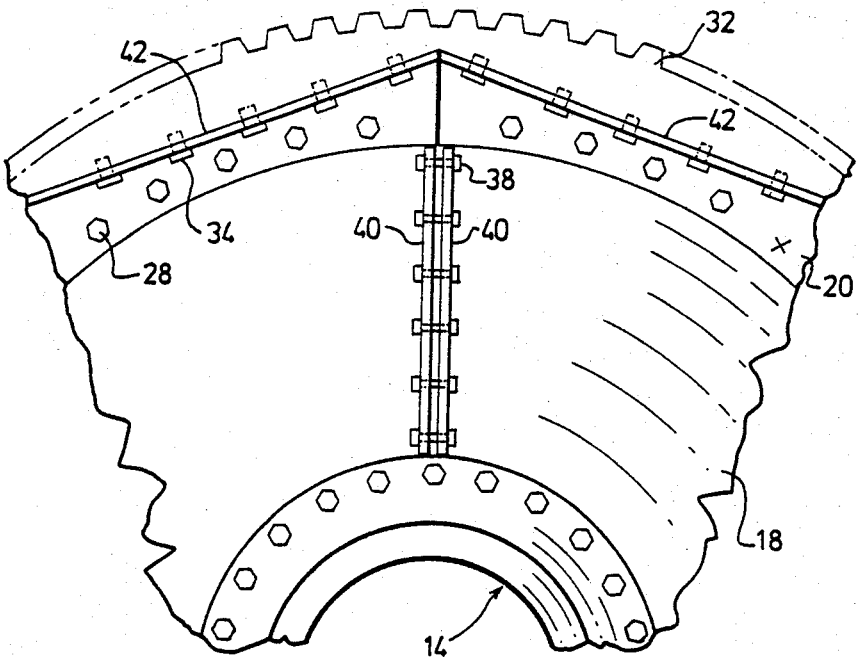
FIG. 5 is a partial end view of the head structure for an alternate embodiment of the present invention.

Referring now to FIG. 5, there is shown a mill head structure wherein the gear flange portion 42 comprises a polygonal shaped ring which is centered about the central axis of the conical head portion 18. Such an arrangement may be provided in light of present day machining technology.

The foregoing has been a description of the preferred embodiment and an alternate embodiment of the present invention. It should be understood that the invention need not be restricted to a specific means for removably securing the gear rim means to the gear flange portion. Further, the specific shape of the gear flange portion and that of the gear rim means need not be identical to that which is shown in the drawings. Accordingly, the present invention should be limited only to that which is claimed in the accompanying claims.

What we claim as new and desire to secure by Letters Patent of the United States is:

1. A mill head structure for a grinding mill having a hollow drum and mounted for rotation on an axis of rotation, said mill head structure comprising:

(a) a conical head portion with a central axis aligned with said axis of rotation, a rib portion integral with and projecting radially outward from said head portion and a gear flange portion integral with and projecting radially outward from said rib portion, said head, rib and flange portions being cast as an integral unit, said head structure being adapted to be secured to said drum adjacent the junction of said head portion with said rib portion with a significant portion of said rib portion extending radially outward relative to said drum, and said gear flange portion having a periphery centered about the central axis of said conical head portion; and (b) a plurality of gear rim means, positioned in juxtaposed relation around the periphery of said gear flange portion, being removably secured with said gear flange portion to provide a continuously toothed gear annulus for accurate meshing relation with a pinion.

2. The invention of claim 1 wherein said gear flange portion comprises an annular ring centered about the central axis of said conical head portion.

3. The invention of claim 2 wherein said mill head structure comprises a plurality of segments each said segment being an integrally cast unit composed of a segment of said head portion, said rib portion and said gear flange portion, said segments of said plurality of segments being arranged in mutually complementary relationship to from said head structure.

4. The invention of claim 1 wherein said gear flange portion comprises a polygonal shaped ring centered axis of said conical head portion.

5. The invention of claim 1 wherein said rib portion includes a lip overlaying a portion of said drum.

6. The invention of claim 1 wherein said conical head portion has an inner annular flange adapted for assembling said conical head portion in secured relation with said grinding mill.

7. The invention of claim 1 wherein said mill head structure comprises a plurality of segments each said segment being an integrally cast unit composed of a segment of said head portion, said rib portion and said gear flange portion, said segments of said plurality of segments being arranged in mutually complementary relationship to from said head structure.

8. In a grinding mill having a hollow drum mounted for rotation about an axis of rotation on spaced trunnions by two head structures located at opposing ends of said drum, the improvement wherein one of the head structures comprises:

(a) a conical head portion having a central axis aligned with said axis of rotation, a rib portion integral with and projecting radially outward from said head portion and a gear flange portion integral with and projecting radially outward from said rib portion, said head, rib and flange portions being cast as an integral unit, said head structure being secured to said drum adjacent the junction of said head portion with said rib portion with a significant portion of said rib portion projecting radially outward from said drum, and said gear flange portion having a periphery centered around the central axis of said conical head portion; and (b) a plurality of gear rim means, positioned in juxtaposed relation about the periphery of said gear flange portion, being removably secured with said gear flange portion to provide a continuously toothed gear annulus for accurate meshing relation with at least one pinion.

9. The invention of claim 8 wherein said mill head structure comprises a plurality of segments, each of said segments being an integrally cast unit including a segment of said conical portion, said rib portion and said flange portion, said plurality of segments being secured together in complementary relationship to form said head structure.

* * * * *